US008887460B1

(12) United States Patent
Hoffman et al.

(10) Patent No.: US 8,887,460 B1
(45) Date of Patent: Nov. 18, 2014

(54) SYSTEM AND METHOD FOR INSTALLATION OF DECORATIVE MOLDING

(76) Inventors: Jeremy P. Hoffman, Philadelphia, PA (US); Robert MacMillan, Perkasie, PA (US)

( * ) Notice: Subject to any disclaimer, the term of this patent is extended or adjusted under 35 U.S.C. 154(b) by 0 days.

(21) Appl. No.: 13/211,124

(22) Filed: Aug. 16, 2011

Related U.S. Application Data

(63) Continuation-in-part of application No. 12/130,912, filed on May 30, 2008, now Pat. No. 7,997,043.

(60) Provisional application No. 60/940,874, filed on May 30, 2007, provisional application No. 60/976,441, filed on Sep. 30, 2008.

(51) Int. Cl.
*E04B 2/00* (2006.01)

(52) U.S. Cl.
USPC ..... 52/288.1; 52/287.1; 52/311.1; 52/716.1

(58) Field of Classification Search
USPC ..... 52/211, 288.1, 289.1, 311.1, 716.1
See application file for complete search history.

(56) References Cited

U.S. PATENT DOCUMENTS

| | | | | |
|---|---|---|---|---|
| 3,205,628 | A * | 9/1965 | Frisk | 52/222 |
| 4,189,888 | A * | 2/1980 | Blitzer, Jr. | 52/506.07 |
| 6,276,101 | B1 * | 8/2001 | Schiedegger et al. | 52/211 |
| 2004/0045239 | A1 * | 3/2004 | Milu | 52/311.1 |
| 2007/0199270 | A1 * | 8/2007 | Weir et al. | 52/506.01 |
| 2008/0163985 | A1 * | 7/2008 | MacKaig | 160/38 |

* cited by examiner

*Primary Examiner* — Brian Glessner
*Assistant Examiner* — Adam Barlow
(74) *Attorney, Agent, or Firm* — Clinton H. Wilkinson; Charles A. Wilkinson

(57) ABSTRACT

A molding system for use in interior spaces at or near the top of a vertical wall having a decorative surface and a vertical mounting surface including an attachment flange used for fastening the molding section to the wall, said molding section having a center of mass which is spaced outwardly from the wall surface, and whereby the point of attachment of said molding to the wall is located at a vertically higher position on the molding section than the center of mass so that when secured to a wall the lower end of the molding section is continually urged towards the wall surface and is therefore maintained in continual contact with the wall surface.

6 Claims, 8 Drawing Sheets

Fig. 2
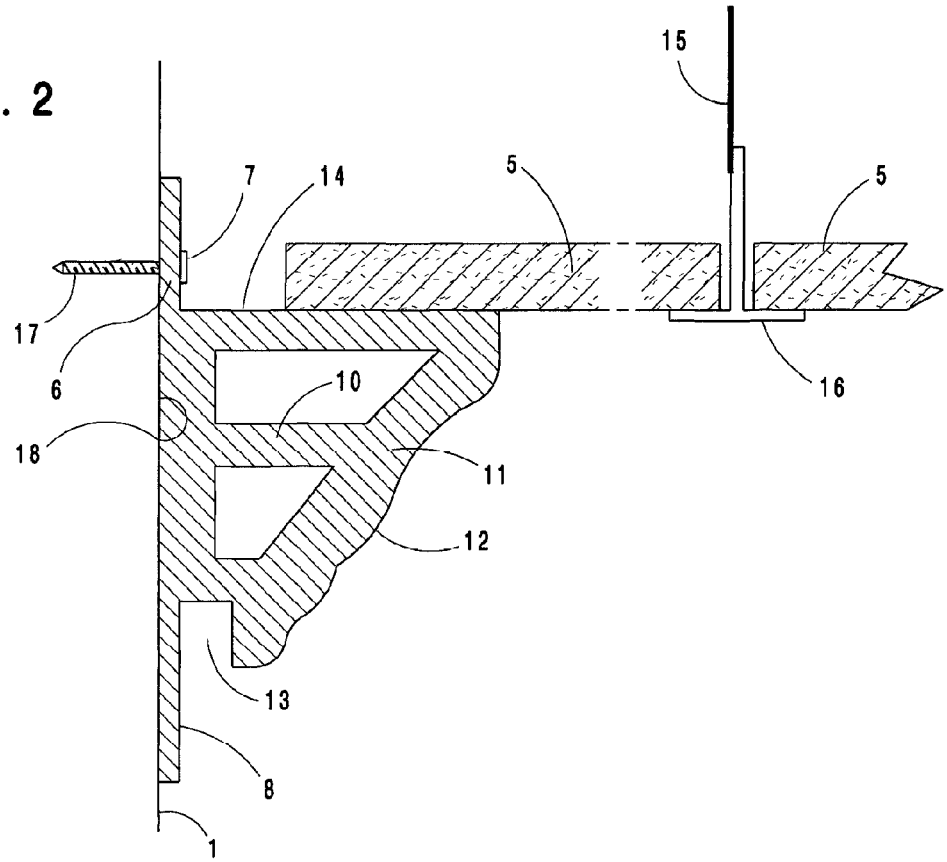
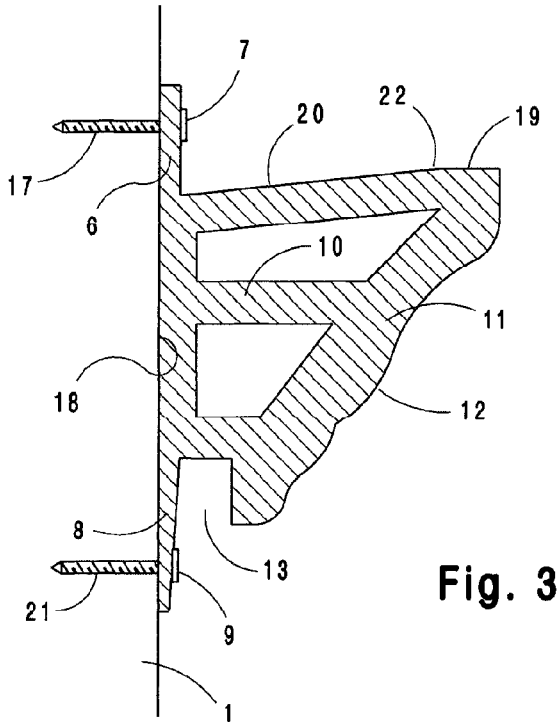
Fig. 3

Fig. 4
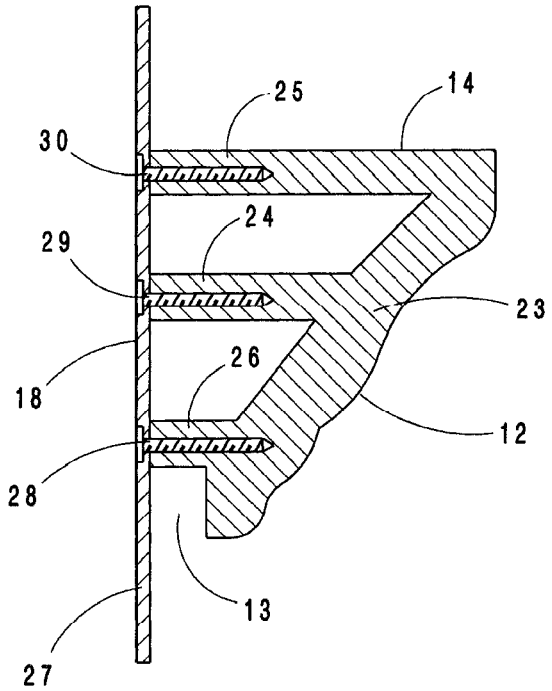
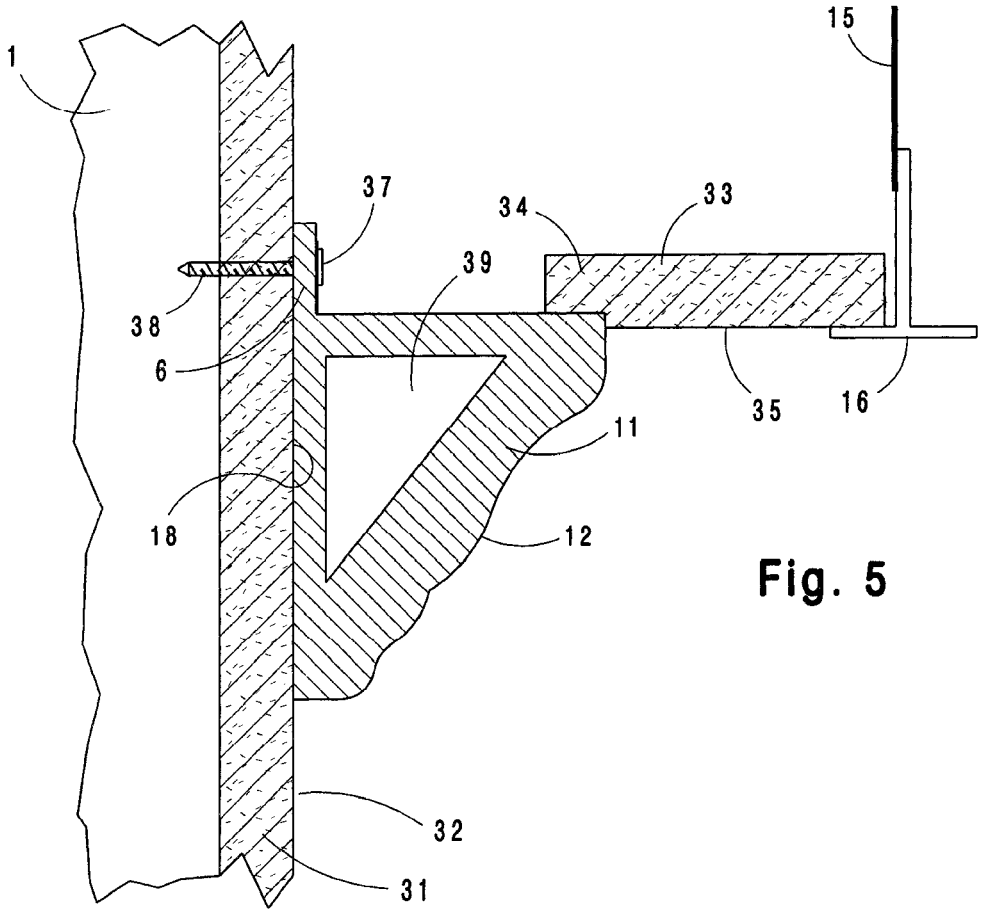
Fig. 5

SYSTEM AND METHOD FOR INSTALLATION OF DECORATIVE MOLDING

CROSS REFERENCE TO RELATED APPLICATIONS

This application claims the benefit U.S. Pat. No. 7,997,043 issued on Aug. 16, 2011, which is based on provisional applications 60/940,874 filed on May 30, 2007 and 60/976,441 filed on Sep. 30, 2007, the disclosures of which are hereby incorporated by reference in their entireties.

BACKGROUND

The present invention is directed to systems and methods for installing decorative molding in a building's interior space, and more particularly to a molding assembly and method of installing molding more quickly and easily in either a new construction or finished interior space, and for installing molding in an interior space having a suspended ceiling.

It is often desirable for buildings' interior spaces to have decorative trim at the top of interior walls. This is usually where the walls meet the ceiling and can be referred to as crown molding. When a building is being built, crown molding is usually installed after nearly all other construction is complete. The timing may be undesirable as there are usually many different types of finishing work that must be coordinated at the same time. Further, many interior spaces require that a suspended ceiling be used, usually to provide ready maintenance access to ventilation and other equipment. Since the suspended ceiling is not structural, the usual method of attaching crown molding to the wall and ceiling does not work. To compensate, a support block must be made to provide an attachment point to the wall, at the top of the molding, near the ceiling. This method adds time and complexity to the process, as well as cost.

Further, crown molding can be added as a decorative addition to an interior space that is already completed and in use. Many times, this is done by individual homeowners to improve the appearance of the space. Installing crown molding can prove a difficult task for a nonprofessional installer. Because of the angle of the molding between the wall and ceiling, making proper corner joints requires precise measurements prior to cutting. A preferred method for installing corner joints is accomplished by scribing the profile of the adjoining surfaces and coping the proper angle—a difficult task for an inexperienced installer. Also, because the molding is attached by fasteners through the decorative face, finishing work must be performed to fill holes.

There are several methods in the current art to address these issues. The example described in U.S. Pat. No. 5,463,835 to Wood illustrates a method for affixing crown molding without attaching to the ceiling surface (see FIG. 4). This method, however, still requires that the walls are built and finished, still pushing the timing to the critical finishing period of construction. Further, the method described in U.S. Pat. No. 5,463,835 also requires the installer to calculate the proper angles to ensure proper assembly. Also note that the method described in FIG. 4 requires several discrete components (not including fasteners).

Another method, detailed in application Ser. No. 11/074,231 by Spek (filed Mar. 7, 2005), requires two interlocking pieces which form the support and face of the molding. This method addresses the difficulty of making suitable cuts resulting in good corner joints by including a system of pre-made corners (see FIGS. 6*a*, 6*b*, 7 and 8). Again, similar to the Wood patent discussed above, this method assumes the wall is finished before installation.

In U.S. Pat. No. 6,643,990 B2, inventor Jensen describes a one-piece system that is adhered to the ceiling as a method of support (see FIG. 4). This would not be useful in an application where a suspended ceiling is to be used. Further, the lack of any internal support structure limits the load that can be applied to the molding.

In U.S. Pat. No. 7,200,970 inventor Koenig describes a molding system that attaches to a constructed, but not finished wall (or ceiling) surface. After the molding is attached to the panel, finishing work (standard to the art) finishes the wall/ceiling surface at the molding, concealing the fasteners and attachment flange. Although this method does incorporate the molding into the finished wall, it does not allow for the molding to be installed prior to wall/ceiling panel installation. Further, the finishing process for wall panels is a time consuming process. It would be desirable to be able to install crown molding in such a way that requires no finishing at the crown molding.

U.S. patent application Ser. No. 11/336,235 (Clements et al.; filed Jan. 20, 2006) describes a system of hiding fasteners used to affix molding to walls and/or ceilings. Note that this method relies on standard installation practices and molding styles with the added functionality to hide the fasteners within the decorative face. As applied to crown molding in the application, the molding angles must still be calculated to form correct corners. Further, the fasteners are described as being set into a "kerf". This kerf is described as running horizontally the length of the molding, with two used at different heights on the decorative face of the molding. This allows two fasteners, one high and one low, to be placed through the decorative face of the molding affixing the molding to the wall and ceiling (see FIGS. 15, 16 and 17). Note that the kerf described has a width and a depth, and is not located at either the top or bottom edge of the molding. Also note that the means for filling the kerf does not provide any support function, and provides no decorative functionality beyond filling the kerf and hiding the fasteners.

BRIEF SUMMARY OF THE INVENTION

The present invention makes installation of crown molding easier in both new construction as well as improvement of existing interior spaces. The invention impacts new construction particularly where an interior space must have a suspended ceiling. The invention first involves a structure that places the decorative face of the molding at the correct angle to the vertical wall surface. By having the decorative face affixed at the correct angle, cutting the molding to create corner junctions is greatly simplified. Instead of calculating compound miters based on the angle of the molding to the wall and the wall corner angle, the installer must simply measure the angle at the wall junction.

When the invention is to be used for new construction with a suspended ceiling, the molding assembly is designed to be affixed to the wall support structure before the wall panels are installed. Most often this is a stud support structure. This invention includes extending the vertical surface of the molding assembly above the height of the decorative face, providing an attachment surface through which a fastener can affix the molding assembly to the studs. The area above the wall, between the suspended ceiling and the bottom of the joists, is generally unfinished space containing wiring, ventilation or other equipment, and is not seen from the finished interior space. By using the upper flange as an attachment point (the bottom flange may also be used) the weight of the molding assembly will press into the stud, in addition to the force of the upper fastener. This invention includes a vertical channel running the length of the molding assembly. This channel is designed to have a wall panel placed against the wall for installation, and then slid up the studs and into the channel for installation. The decorative face of the molding assembly starts at the side of the channel opposite the stud. Once the wall panel is in place, it is attached to the studs using standard practices. This provides a clean joint between the decorative face of the molding assembly and the wall panel. Additionally, by filling the channel, support is provided to the molding assembly further anchoring it to the studs.

Once the molding system has been affixed to the wall studs, the suspended ceiling can be installed. This is because the ceiling tiles as well as the peripheral framing can rest on the top edge of the decorative face of the molding system. Note that this also provides a finished joint between the ceiling and the crown molding.

The benefits of the present invention in new construction with a suspended ceiling include also process and timing benefits. Because the molding assembly is installed directly to the wall's support structure, it can be installed before the wall panels are installed. This could be accomplished while other tasks (such as electrical work, plumbing, insulation, etc.) are being performed that require the open wall structure. This means that adding crown molding to a new project may not mean adding time to the overall project. Further, the ceiling installation no longer needs to wait for the walls to be finished, saving process time.

Another way the present invention saves time is by a lack of finishing work required. None of the fasteners used to affix the molding assembly ever go through the decorative face. This saves considerable time and labor. Also, the molding can be painted before it is installed, since the decorative face is never violated by the process.

In addition to being used in new construction, the present invention can also be used to improve an existing interior space. For a space with a suspended ceiling, or for an existing space where a suspended ceiling is to be installed, the assembly is as described above, but with no channel for a wall panel at the bottom. Thus, the vertical surface that attached to the wall has an attachment point extending above the height of the decorative face (and hidden by the suspended ceiling), but in this case the vertical surface terminates at the bottom of the decorative face. There is no lower attachment point for this example. For this suspended retro-fit example the bottom of the decorative face is the bottom of the molding assembly, and terminates at the wall surface. As above, when the suspended ceiling is placed, the weight of the ceiling holds the molding assembly to the wall, in addition to the upper fastener.

The present invention can also be used in an existing interior space without a suspended ceiling and with a standard fixed ceiling. Here the molding assembly has a lower attachment point, and no upper attachment point. The vertical mounting surface of the molding assembly does not extend above the height of the decorative face (and may be slightly below). The lower channel exists in this example, but not to accommodate a wall panel. The vertical mounting surface extends below the decorative face of the molding assembly and provides an attachment point. A vertical channel will run the length of the molding inside the bottom edge of the decorative face. This channel will likely be thinner, as more material will be needed on the flange to strengthen and provide support from the lower attachment point for the molding assembly. This example also includes a second piece that fills the vertical channel, hides the fastener and lower attachment point. This second piece also provides increased rigidity by filling the vertical channel and preventing the molding assembly from sagging and pulling the top edge of the decorative surface away from the ceiling. Also, the outer surface of the second piece will be a decorative face, and will complete the crown molding's decorative face from the start of the channel to the wall surface below the lower attachment point. The second piece will be retained in the channel by any existing method for doing that, such as a ridge on the second piece and a matching notch in the molding assembly.

BRIEF DESCRIPTION OF THE DRAWINGS

FIG. 2 is a cross sectional view of an embodiment of the present invention wherein the molding assembly is secured to the wall structural members at a single high attachment point, and illustrating the manner of placement of a suspended ceiling frame and tiles.

FIG. 3 is a cross sectional view of an alternative embodiment of the present invention using both a high and a low attachment point to the wall structural members (not shown), and also illustrating some different contours and angles for the supporting structure of the system.

FIG. 4 is a cross sectional view of another alternative embodiment of the present invention in which the molding assembly is comprised of two separate pieces which are joined together to form the system.

FIG. 5 is a cross sectional view of another alternative embodiment of the present invention illustrating the molding system adapted for use with an already assembled wall and placement of a suspended ceiling frame and tiles.

DETAILED DESCRIPTION OF THE INVENTION

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. Reference will now be made in detail to the preferred implementation of the present invention as illustrated in the accompanying drawings. Wherever possible, the same reference numbers will be used throughout the drawings and the following description to refer to the same or like parts.

Figure 1:
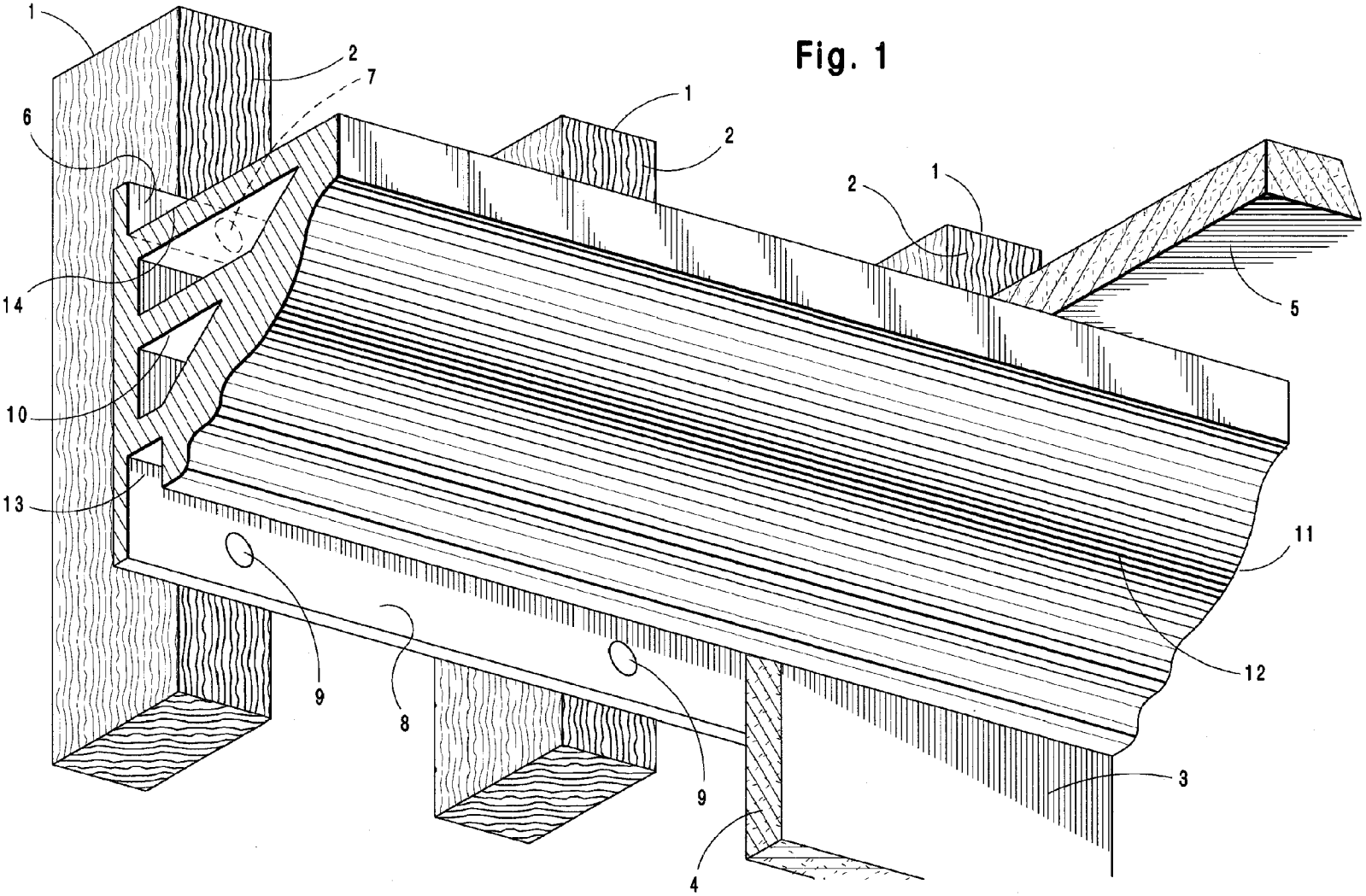
FIG. 1 is a perspective view of a first preferred embodiment of the present invention, which illustrates the longitudinal nature of the invention (from left to right in this Figure) and shows in the foreground the wall studs to which the invention is affixed, and on the right side of the figure the placement of a wall panel and a ceiling panel.

FIG. 1 provides a perspective view of a decorative molding system embodying the principles and concepts of the present invention, and FIGS. 2 through 11 illustrate alternative embodiments, constructions, and manners of use of the present invention. Wherever possible, like components are identified by reference numerals similar to the reference numerals for like components of the previous embodiments. Referring now in particular to FIG. 1, the main structure 11 of the molding system is one piece and the entire system for this embodiment comprises one piece. Although the representation of length of structure 11 in FIG. 1 is finite, it will be understood that the molding system may extend longitudinally as needed. Usually this length is the length of the wall on which this system will be installed. Fasteners are not denoted as part of the system in this embodiment. The system's main structure 11 is a rigid structure having a decorative front surface 12, upper surface 14, and a rear surface 15 (not shown), being held together by an arbitrary internal support structure 10. As such, the internal support structure 10 serves to ensure that decorative surface 12 is held rigid and fixed with respect to the vertical mounting surface 18 (see FIG. 2 for 18). Arbitrary support structure 10 will also maintain the rigidity of the structure 11 such that upper and lower attachment flanges 6 and 8 located above upper surface 14 and below decorative surface 12, respectively, remain in a fixed orientation. In addition, a vertical channel 13 is provided behind the lower edge of decorative surface 12 and flange 8. The exact structure of the internal support structure 10 will be determined using standard materials science and engineering, and will depend on the needs of the materials chosen. It is specified here that the internal support structure 10 must be strong enough to support all of the components of the molding system 11 in proper orientation with the necessary components of a suspended ceiling, including ceiling tile 5, resting on the upper contact surface 14.

One of the benefits of the present invention is that achieving the necessarily precise cuts of the molding structure 11 is much improved over ordinary decorative crown molding. This benefit is achieved because the main structure 11 of the molding assembly is rigid, and thus always maintains the correct angle of the decorative face 12 to the vertical mounting surface 18 (see FIG. 2 for 18).

Still referring to FIG. 1, reference numeral 1 identifies the wall structural members, hereon referred to as studs. There are three studs visible in FIG. 1, but any number may be present in a structure's walls, depending on wall length, building codes and other factors. Studs 1 have an outer surface 2 onto which the main structure 11 of the molding system will be affixed. Note that the outer surface 2 of studs 1 is the same surface onto which the wall panel 3 will be affixed. The molding assembly is affixed to studs 1 using any standard fasteners 7 and 9. In this embodiment, one fastener 7 will penetrate through the upper attachment flange 6 of main structure 11 at each location of a stud 1 along the length of the installation of the molding system. Also, fasteners 9 will be used in a similar manner as fastener 7, however they will penetrate through the lower attachment flange 8. In this embodiment, fasteners 7 and 9 may be screws or nails of common nature. Holes for fasteners 7 and 9 may be drilled, as pilot holes are commonly used, before the fastener is placed. Alternately, the screw or nail may be used to create its own hole as it is used. The choice to drill a hole through attachment flanges 6 and 8 may be made by the installer or determined by the qualities of the material used to manufacture the structure 11 of the molding assembly. In addition, the choice of fasteners 7 and 9 and the method of use may vary depending on the needs of the material used in this embodiment, and standard practices for attaching those materials.

Once main structure 11 of the molding system of the present invention in FIG. 1 is affixed to the studs 1, the wall panels can be placed. In this embodiment, wall panel 3 is a standard panel such as a gypsum wallboard panel. The wallboard 3 is of uniform thickness 4, except for the common practice of including tapered seams at two of the edges of the wallboard. One of these seams can be easily removed for this embodiment if necessary. The horizontal width of the vertical channel 13 in main structure 11 matches the width of the wallboard, or is slightly wider as needed, such that when wall panel 3 is placed against the stud surfaces 2, wall panel 3 can be slid up stud surfaces 2, sliding over lower attachment flange 8 and fasteners 9 and into vertical channel 13. Once wall panel 3 has been seated in vertical channel 13, the wall panel will be affixed to stud surfaces 2 using standard practices for gypsum wall panel installation.

When wall panel 3 has been attached to stud surfaces 2, the junction between wall panel 3 and decorative face 12 should be a finished surface, albeit unpainted, with no wall finishing work such as spackling necessary for this joint. This provides a labor saving advantage over traditional crown molding installation. Further, note that the crown molding system has been installed without any fasteners, or other procedures, damaging or penetrating decorative face 12. This is also a labor saving advantage as there are no fastener holes to be filled, as is the case with traditional crown molding.

Benefit can also be gained through moving the installation of this crown molding system earlier in the process than is possible with other methods of crown molding installation. This is due to the fact that molding system is affixed directly to the wall structural members 1. Thus, unlike traditional crown molding installations, the present inventor's crown molding system can be installed at any point after the wall framing is complete. This allows for the crown molding installation to be moved from the end of the construction process, where many finishing jobs need to be done and may conflict, to a point in the construction where very little finishing work is to be done. Before wall panels can be attached to framing there are many jobs that must be accomplished. These include electrical and plumbing, among others. Thus, using the present inventor's system the crown molding can be installed before the wall panels are installed, possibly at the same time as electrical work and plumbing are being done. This can be a benefit as it does not add to process time during a building project.

Further benefit of the invention comes from the ability to finish the decorative surface 12 before installation of the wall panels. Because decorative surface 12 is never marred by the installation process, it can be finished before installation and expected to appear finished at project completion, barring construction accidents or mishaps. Paint can be used as the finish of choice in this embodiment. Paint can be applied either before installation, or can be applied after installation, but before wall panel installation for labor savings. If spraying is the method of application, the painter must only worry about adequately covering decorative surface 12. Further, the painter does not need to be concerned about over spray as none of the other components of the molding system will be visible upon project completion. The benefits of spray application also apply to painting after molding system installation, but before wall panel or ceiling installation. Some overspray may exceed molding system 11, but any over spray will be hidden by the wall panels and ceiling once installed.

In addition to paint, the invention as described in this embodiment may also have a wood-like covering or sticker applied to decorative surface 12, or color throughout if colorable materials are used in manufacturing.

Installing molding system 11 also allows for the suspended ceiling to be installed before the wall panels are installed. This is ordinarily not possible, as the frame for the suspended ceiling is usually attached to the finished wall panel where the wall meets the ceiling. By using the present inventor's molding system 11 the builder gains the flexibility to install the frame for the suspended ceiling, and the ceiling tiles 5, anytime thereafter.

FIG. 2 is a cross sectional view of the present invention in a similar embodiment to that illustrated in FIG. 1. Included in FIG. 2 are depictions of two ceiling tiles 5, as well as suspended ceiling framing member 16 and suspending wire 15. In this embodiment the ceiling tiles 5 and framing members 16 that extend to the junction of the ceiling and molding system 11 will come to rest on the upper contact surface 14. This will form the finished joint between the ceiling and molding system 11.

The function of the invention as illustrated in FIG. 2 is similar to that described for the embodiment in FIG. 1, with a few differences. For illustrative purposes, the shaft 17 of fastener 7 is visible. In this case, a screw is shown as it has penetrated the upper attachment flange 6 and stud 1. Also, the embodiment illustrated in FIG. 2 does not use a fastener through lower attachment flange 8. This illustration also shows how vertical mounting surface 18 will rest directly on stud surface 2. It should also be noted that the thickness of the lower attachment flange in this embodiment may be thinner than that portrayed in FIG. 2. This may be desirable to keep wall panel 3 (see FIG. 1) as plumb as possible.

FIG. 3 illustrates another embodiment of the present invention that functions similarly to the previous embodiments. In FIG. 3, shafts 17 and 21 of fasteners 7 and 9, respectively, are shown, which fasteners in this embodiment are nails. Also note that the lower attachment flange 8 is tapered to be narrower at the bottom of vertical channel 13. This taper may more easily accommodate insertion of wall panel 3 (see FIG. 1) so it is closer to plumb after it is installed. FIG. 3 also depicts a smaller upper contact surface 19. Upper contact surface 19 is horizontal, and is the surface upon which the ceiling will rest. At point 22 upper surface 20 angles away from the horizontal to meet upper attachment flange 6 at a lower point on molding system 11.

FIG. 4 illustrates another embodiment of the molding system of the present invention whose function and use are very similar to the previous embodiments, but whose construction is different. In this embodiment, the molding system is comprised of two joined pieces, namely main structure 23 and plate 27. These can be dissimilar materials. In one implementation, plate 27 is made from metal, and structure 23 is made from another material such as a plastic or a rigid foam. These two components are joined in the manufacturing process by fasteners 28, 29 and 30. The fastening of the two components is accomplished using fasteners known in the art to be able to join these two components into a rigid structure. As in the other embodiments, the design of the internal supports 24, 25 and 26 will be such that the entire molding assembly is rigid as described above.

A key advantage of the embodiment as illustrated in FIG. 4 is the ability to construct the invention to be part of a fire resistant wall. There are many situations in which building codes will require an interior wall to be fire resistant. This embodiment could increase the fire resistance of the invention by using metal, or other fire resistant materials, for plate 27. Fire resistance could be achieved by using fire resistant wall panels in the manner described above. In addition, fire resistant wall panels could be installed on the studs above the molding system, and continuing to the bottom of the roof. By resting the bottom of the fire resistant wall board panel on upper contact surface 14, it can be ensured that the wall is covered from roof to floor with fire resistant materials.

FIG. 5 illustrates another embodiment of the present invention that is designed to be installed onto an already finished wall, and in addition provides support for a suspended ceiling. While this embodiment does not enjoy the advantages achieved during construction of the previous embodiments, it does offer advantages for those wishing to install crown molding in existing interior spaces with a suspended ceiling. Note that the benefits related to the simplicity of angled cuts for corners are realized with this embodiment, as decorative face 12 is always held rigid and fixed with respect to vertical mounting surface 18. Note also that the internal structure 39 is simplified, as no cross pieces are provided. As before, the only requirements for internal structure 39 as it relates to this invention is that it maintains the rigidity of the entire main structure 11 of the molding system, including the upper attachment flange 6 and all other components.

Fastener 37 in FIG. 5 is used to affix main structure 11 of the molding system to a wall, with shaft 38 penetrating upper attachment flange 6 as well as wall panel 31 and fastening into stud 1. Note that in addition to the force of fastener 37, the physical weight of main structure 11 alone will cause vertical mounting surface 18 to be continually pressed against finished wall surface 32. The weight of ceiling tile 33 resting on upper contact surface 14 will also contribute additional force seating main structure 11 of the molding system against finished wall surface 32.

Although any commonly used ceiling tile application can be used with the present inventor's molding system, ceiling tile 33 illustrates a commonly used type of ceiling tile whose decorative face 35 protrudes below the suspended ceiling framing member 16 and the upper contact surface 14 of main structure 11. Ceiling tile 33 of this type is supported by recessed surfaces 34.

Figure 6:
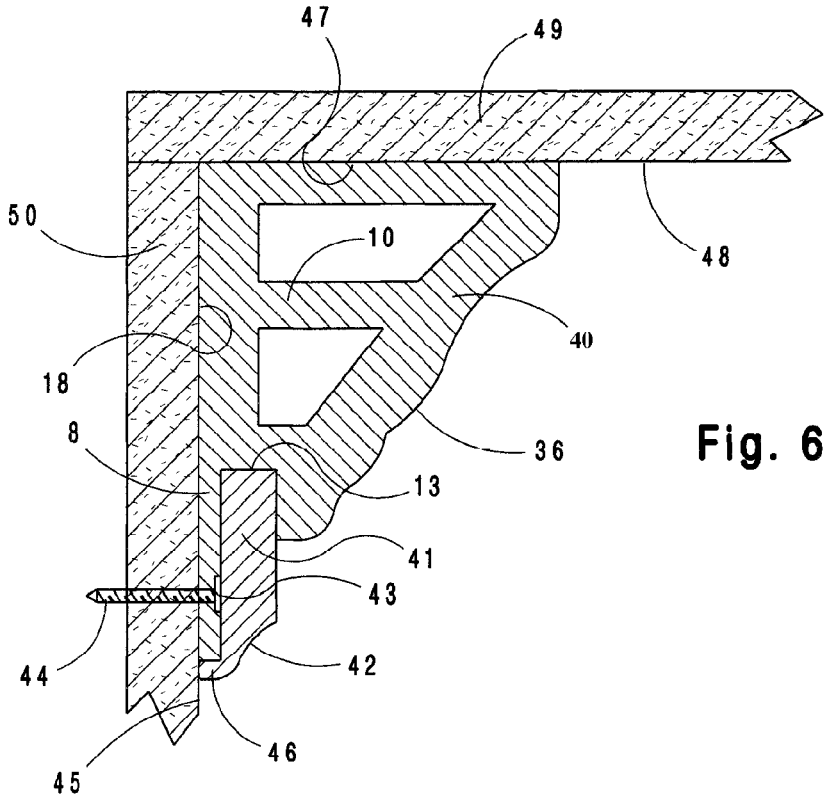
FIG. 6 is a cross sectional view of another alternative embodiment of the present invention in which the molding system is adapted to be affixed to a finished wall and against a finished ceiling, not a suspended or removable ceiling.

FIG. 6 illustrates an embodiment of the present invention for installing the molding system in an interior space whose wall panels have already been installed, and in addition which uses a fixed rigid ceiling with the ceiling panels already installed. In most cases, this embodiment will be used where the wall and ceiling surfaces have already been finished. This is a type of interior space common to many residences.

This embodiment differs from previous embodiments in that the molding system installs as two components, which are designated generally as main structure 40 and lower structure 41. These two pieces will preferably be supplied together, and cutting the molding assembly while both pieces are together ensures matching angles upon installation. After the necessary cuts in the molding system are made, main structure 40 and lower structure 41 are separated.

In FIG. 6, reference numeral 49 refers generally to the finished ceiling, while reference numeral 50 refers to the finished wall. As is the case in most construction, the wall and ceiling are constructed of wall panels attached to structural members, not shown. The main structure 40 of the molding assembly is placed as shown in the corner where the ceiling meets the wall. Main structure 40 is installed such that upper contact surface 47 is seated against finished ceiling surface 48, and vertical mounting surface 18 is seated against finished wall surface 45. Without lower structure 41 in place, the installer will have access to lower installation flange 8 and will drive fastener 43 through flange 8 and finished wall 50, fastening shaft 44 of fastener 43 sturdily into a structural member.

At this point, the main structure 40 is installed. While lower installation flange 8 is designed, in this embodiment, to be strong enough to hold the main structure 40 in place, this is not the only support for the molding system. The molding system is completed by sliding lower structure 41 into vertical channel 13. Lower structure 41 covers both lower installation flange 8 and fastener 43, and lower decorative face 42 combines with upper decorative face 36 to provide a continuous decorative face from finished wall surface 45 to finished ceiling surface 48. Lower structure 41 also provides support for main structure 40 by filling vertical channel 13 and preventing upper contact surface 47 from falling away from finished ceiling surface 48. As in the other embodiments of this invention, the internal structure 10 of the main structure 40 as illustrated in both FIG. 6 and FIG. 7 is only relevant as a means of maintaining the rigidity of the invention in this embodiment.

Figure 7:
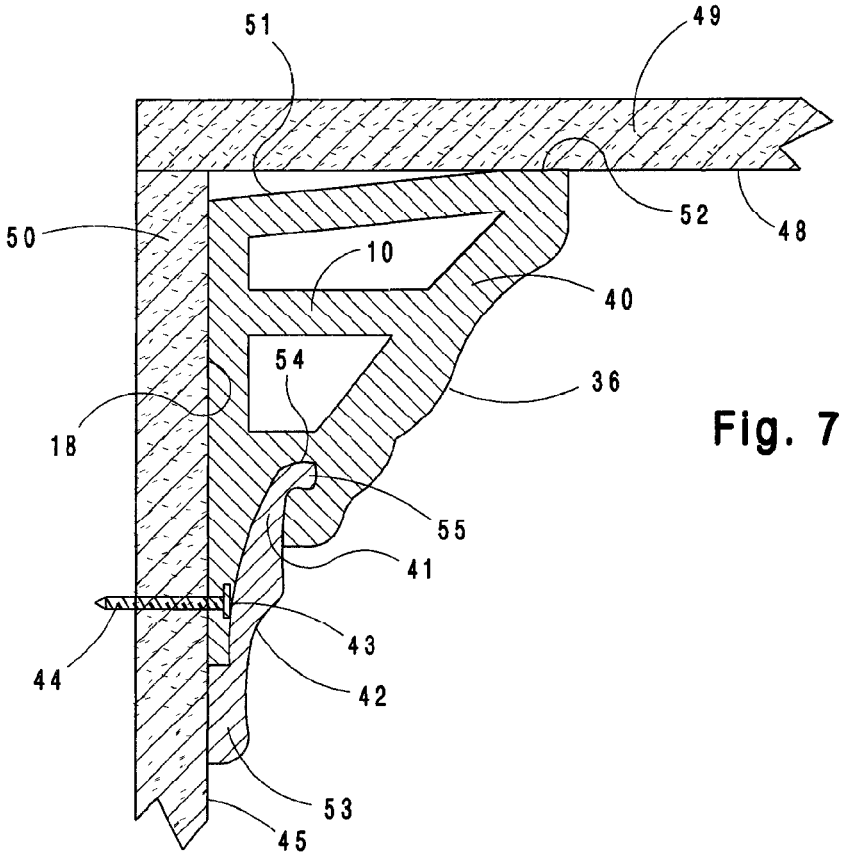
FIG. 7 is a cross sectional view of another alternative embodiment of the present invention in which the system is affixed to a finished wall and against a finished fixed and rigid ceiling.

FIG. 7 illustrates several variations of the embodiment illustrated in FIG. 6, but otherwise functions in much the same way. One difference is that similar to the embodiment shown in FIG. 3 the upper contact surface 52 comprises a much smaller portion of the upper surface of main structure 40 in this embodiment. Upper surface 51 angles down from the horizontal surface as it moves toward vertical mounting surface 18. This provides an advantage in that often the corner where finished wall surface 45 meets finished ceiling surface 48 is not a true ninety degrees. This occurs as finishing materials such as tape and joint compound are built up to finish the joint, and layers of paint accumulate. Having a smaller upper contact surface 52 close to upper decorative face 36 will allow a good seat between upper contact surface 52 and finished ceiling surface 48 even if the corner has significant build up.

Lower attachment flange 8 and lower structure 41 have also been altered in this embodiment in comparison to the arrangement shown in FIG. 6. Here, attachment flange 8 has been made thicker where it joins main structure 40. This is to gain strength during the installation process, before lower structure 41 is installed to complete the structure. In addition, lower structure 41 has been altered to match the revised vertical channel 54. Note that vertical channel 54 now has a notch, which matches a protrusion on lower structure 41. The arrangement shown in FIG. 7 is illustrative of one method for keeping lower structure 41 in place once installed, and it will be understood that this method and other methods in the art may be used for this purpose.

Another facet of the embodiment illustrated in FIG. 7 is the extension of lower decorative face 42 on lower structure 41. Area 53 of lower structure 41 is created to offer an extended area of decoration to the molding assembly. It will therefore be understood that decorative surface 42 of lower structure 41 may be provided in any number of different patterns, designs, lengths, or the like to match surface decoration 36 of main structure 40.

It will be evident from the various embodiments of the crown molding assembly or system of the present invention described above that the invention can be embodied as designed to be attached to and utilized in combination with either an unfinished wall, as shown in FIGS. 1-4, a finished wall having a nonstructural ceiling, as shown in FIG. 5, or a finished wall and structural ceiling, as shown in FIGS. 6 and 7. FIGS. 8-12 illustrate and clarify several additional embodiments and features of the molding assembly of the present invention as it is adapted for use with a finished wall, and a nonstructural ceiling, and in addition, where desired, for defining an interior room environment spaced apart from a ceiling structure.

Figure 8:
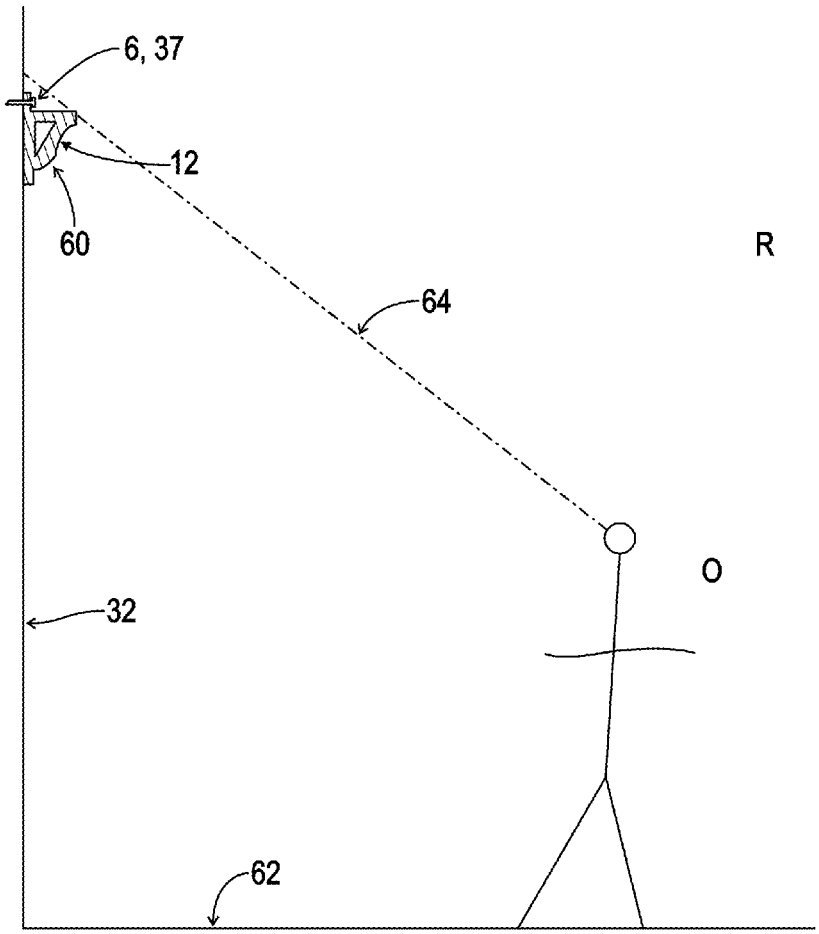
FIG. 8 is a diagrammatic view of the molding system applied to a wall surface of an interior room.

More particularly, in a traditional manner a crown molding is placed in a location at or near the top of an interior wall. FIG. 8 illustrates an embodiment of the present invention structurally similar to that described above with reference to FIG. 5, applied in a typical room setting (R) which is generally defined by wall surface 32 and a floor 62, with the molding assembly 60 of the present invention secured to wall surface 32. From the perspective of a typical occupant (O) of room (R) who is uninformed of the present invention, the molding assembly appears to be similar to common or conventional crown molding in terms of both its physical appearance and placement relative to the room's wall surfaces 32 and floor 62.

Such arrangement can be useful when the walls of a structure are much higher than the desired wall height within, or in other words, where there is no ceiling at such desired wall height but it is desired to give the perception of a room space or dimensions having a ceiling height lower than the actual ceiling height. One example of this is a grocery store having a large open design, with fifty foot high ceilings and an industrial design appearance, wherein there is a café placed. In creating a separate decor for the café within the open environment of the larger structure, the presently described embodiment may be useful to separate or define the finished café space and at least perceptively separate it from the higher open walls without building a ceiling. As shown in FIG. 8, the embodiment of the present invention 60 wherein the installation flange 6 extends upwardly is preferred because the installation flange and fastener 37, which defines the attachment point of the molding structure to the wall surface, will be largely out of the sight-line 64 of occupants (O) in the interior space when the molding assembly is placed at appropriate height within the space. The presently described arrangement thus presents an important advantage over the current state of the art for crown molding installation in that the decorative face 12 is not disturbed by fasteners or by other wall finishing materials such as spackle, caulk, and the like used in other inventions.

Figure 9:
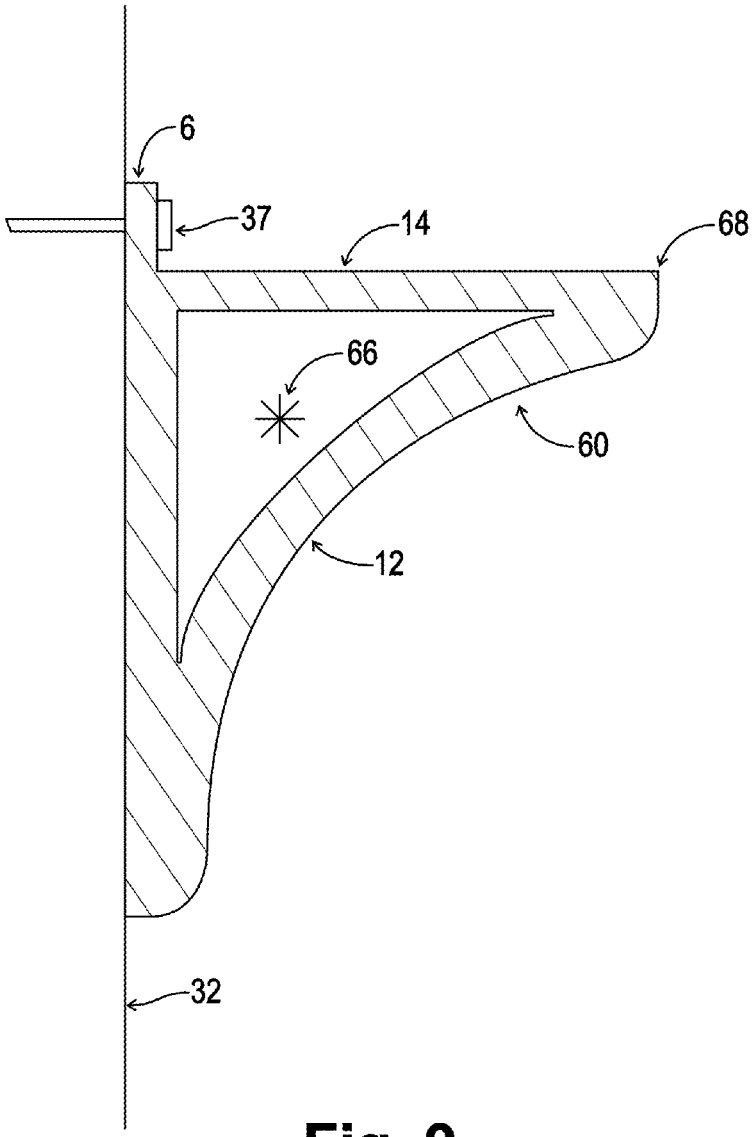
FIG. 9 is a side sectional view of an embodiment of the molding system of the present invention having an upper attachment flange and illustrating the center of gravity of the main structure.
Figure 10:
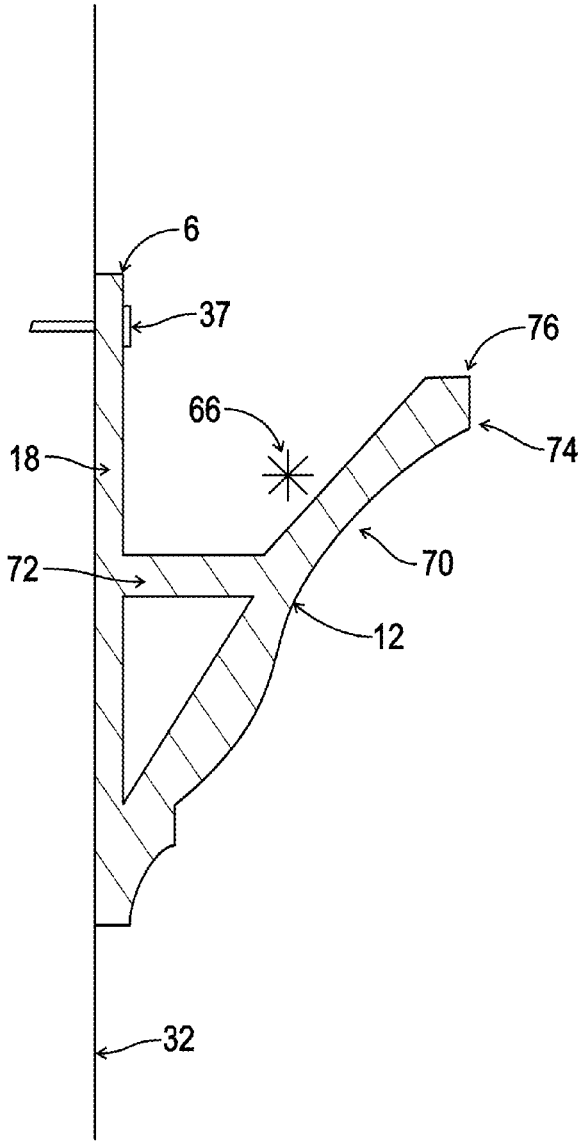
FIG. 10 is a side sectional view of another embodiment of the molding system of the present invention having an upper attachment flange.

FIGS. 9 and 10 each illustrate differing embodiments of the invention that can be used in the above-described "open room" environment. Although somewhat different, the structures of the embodiments shown in FIGS. 9 and 10 both serve the necessary purpose of maintaining the desired angle and position of the decorative face 12 relative to the wall 31 or vertical surface, which will usually be the wall surface, on which the molding assembly is installed. In addition, both maintain the structure such that the upper attachment flange 6 and the attachment point of fastener 37 for the molding system to the intended wall 31 is above the center of mass 66 of the crown molding assembly 60.

FIG. 9 is similar to the embodiment shown in FIG. 5, in that the upper surface 14 extends outwardly substantially perpendicularly from the lower edge of attachment flange 6. While as described in FIG. 5 upper surface 14 also comprises a nonstructural ceiling support surface, it can also be used in the manner described above with reference to FIG. 8. It will also be noted that preferably, the upper edge 68 of decorative surface 12, or the point where upper surface 14 joins decorative surface 12, is positioned a distance from wall surface 32 which is several times greater than the length or distance attachment flange 6 extends upwardly beyond upper edge 68. Preferably, the distance of upper edge 68 from wall surface 32 is at least two to six times greater than the distance attachment flange 6 extends above upper edge 68, and more preferably is between four and six times greater than the distance attachment flange 6 extends upwardly beyond upper edge 68. Not only does this arrangement ensure that the desired angle for the decorative face 12 of the molding assembly is provided, but it also ensures that the attachment flange and associated attachment point will be hidden from normal view in a typical room environment where the molding assembly is not being used to support a nonstructural ceiling panel on upper surface 14. It is further noted that where a nonstructural ceiling is being supported by the molding system, the length or dimensions of attachment flange 6 in relation to upper edge 68 of decorative face 12 is not important, since flange 6 will be hidden from view by the ceiling system and thus can have any length or dimensions.

In embodiment 70 of the present invention shown in FIG. 10, horizontal support member 72 extends between vertical wall engaging or mounting surface 18 and decorative face or surface 12 of the molding assembly at a position which is spaced from the upper end 74 of decorative surface 12. The angle of decorative surface 12 is nevertheless rigidly maintained. Further, the upper edge 76 of decorative surface 12 is also a distance from the wall surface 32 which is several times greater than the distance attachment flange 6 extends upwardly above such upper edge 76. Thus, it is not the length of the attachment flange 6 but rather the length or distance it extends upwardly beyond or above the upper edge 76 of the decorative surface 12 in relation to the position of such upper edge 76 that is important to the presently described utility of the invention. As indicated above, where such upper edge 76 is used to support a nonstructural ceiling, this relationship does not apply.

Maintaining the desired angle and position of the decorative face 12 relative to wall surface 32 and therefore the structural rigidity of the molding assembly (60 in FIG. 9; 70 in FIG. 10) relative to the attachment flange 6, the decorative face 12 and the installed wall 32, allows for several benefits. First, it simplifies the cutting process required to complete a crown molding installation in an interior room, in that the angle of the decorative face is maintained as it is being cut, simplifying the angle measurements and increasing the likelihood that mitered cuts will line up where different pieces meet, or in the corners of the room. Second, this means that the only attachment point needed is the one on upper attachment flange 6. This is important in that most other methods require fasteners to be driven through the decorative face, and then have holes patched later. Some other systems require that wall finishing materials such as spackle, caulk or others be used to complete installation, increasing process time and complexity, while other systems for crown molding require multiple pieces to be installed.

It is also noted that the present invention has been described herein with respect to one or more of the embodiments as having a particular internal structure that gives it a required structural integrity. It is further noted, however, that as long as the various particular parts of the invention are constructed in a manner that provides such required structural integrity, as evidenced in FIG. 5, an internal structure such as internal support member 10 provided in the embodiment of FIG. 1 may be omitted, although as discussed previously with reference to FIG. 4 the internal structure of the invention is considered to broadly include internal supports 24, 25, and 26, rather than just internal support 24 or another similar support.

By maintaining as shown in the above embodiments a one piece crown molding system, that maintains the correct positioning of the decorative face throughout the installation process, and whose installation requires using one attachment point that is naturally hidden from view, with no need for using finishing materials or caulk, and no need to fill fastener holes, this system and method delivers benefits that are different and unique from the current state of the art.

Figure 11:
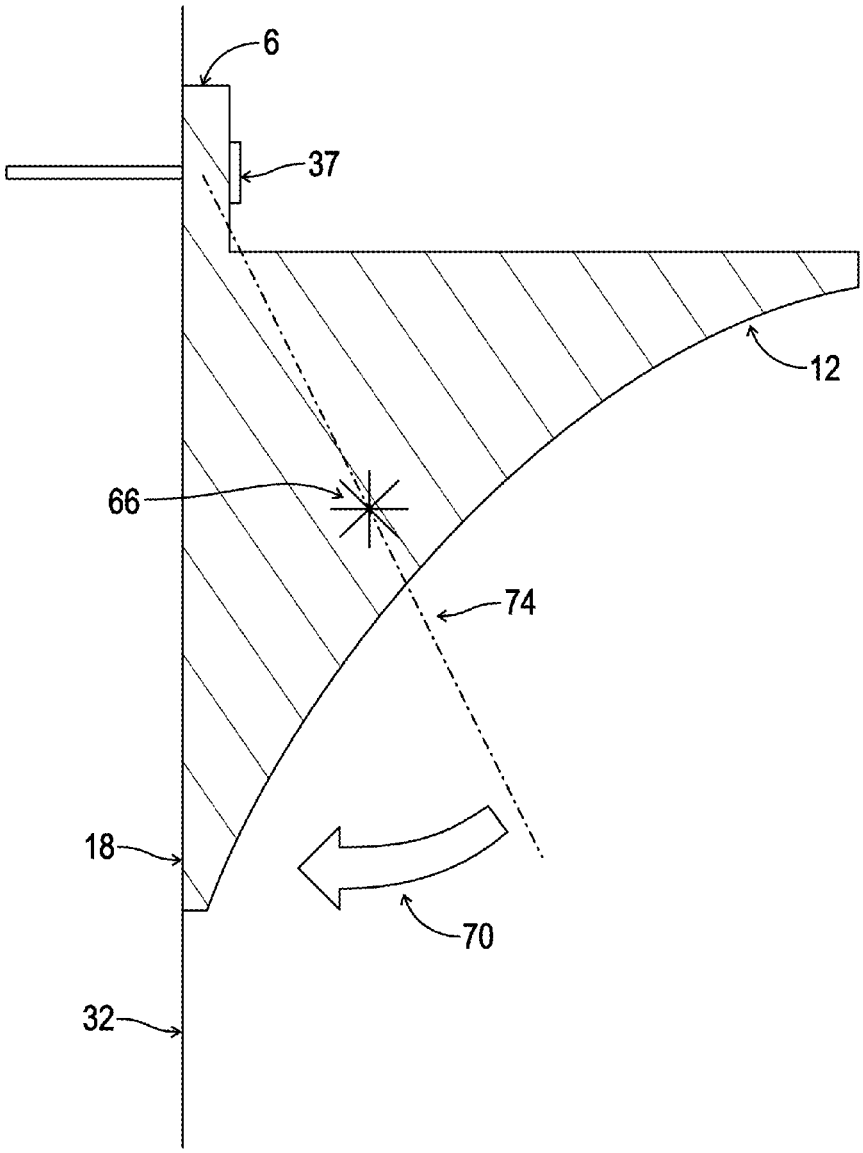
FIG. 11 is a cross section view of an embodiment of the present invention having a single upper attachment point and illustrating the pendulum force created by the position of the center of gravity.

In addition, as illustrated in FIG. 11, perhaps the most important benefit of the presently described embodiments of the invention is that the molding system, when installed at the attachment point using a fastener 37 through upper attachment flange 6, will naturally experience a force, indicated by arrow 70, that reinforces the desired placement of the decorative face 12 against wall surface 32, especially where the decorative face 12 meets the wall. As mentioned above with reference to FIG. 5, the position of the majority of the weight of the molding assembly is spaced from the vertical wall surface 32 when such assembly is secured to vertical wall surface 32 by fastener 37 at upper attachment flange 6 and its associated attachment point. This causes vertical mounting surface 18, or the rear surface of the decorative face, of the molding assembly to be continually forced or urged towards or against the vertical wall surface 32, while the added weight of ceiling tiles 33 resting or supported on upper contact surface 14 would only further increase such force or pressure against wall surface 32. This force may be represented by using the "simple gravity pendulum" model. This model assumes that there is no friction at the pendulum pivot, indicated by line 74, and that the rod that connects to the weight is massless. Using this model, the pivot point would be at the attachment point where fastener 37 joins the molding system to the wall surface 32. The weight would be exactly at the center of mass 66, and would be the complete weight of the molding system. This results in the force 70 as seen in FIG. 11 which reinforces placement of the decorative face 12 as it meets the wall 32 at its lower end. For the crown molding system to act as a pendulum, there must be only one attachment point (which acts as the pivot for the pendulum) and the attachment point must be higher than the center of mass of the crown molding system.

As described above, asterisk 66 in FIG. 11 represents the center of mass of the molding assembly. The exact location of the center of mass is estimated in the embodiment illustrated in FIGS. 9 and 10 and would be expected to be in differing locations depending on, and therefore is defined by, the structure chosen, materials used, material thickness, etc. of the molding assembly. Most important, however, is that no matter which structure or material is used, the center of mass 66 will be away from the installed wall surface 32, since all of the structure is positioned to one side of the wall surface 32 and therefore the pendulum force 70 will result, as long as the attachment point (such as via fastener 37) is higher than the center of mass 66. Also note that this rotational torque 70 would be augmented, in a positive way, if the presently described embodiment is used in an application where a suspended ceiling is supported by the molding system. See again FIG. 5.

An object of the embodiments of the present invention described with reference to FIGS. 8-11 is therefore to provide a molding assembly wherein the center of mass of the main structure of the molding assembly is defined to aid in urging the lower end of the structure towards the wall surface to which the upper attachment flange 6 is secured. When considering a mass body, the body is defined as a matter of physics to have a "center of mass". The center of mass in three dimensions is defined at a point representing the mean position of the matter in the body, or the point that moves as though all of the mass were concentrated there and all external forces were applied there. The center of mass of a body does not need to be a physically defined structure, and can be a virtual point calculated from the weighted mean of the mass portions of the body. The weighted mean accounts for the amount and specific gravity of each material used and its relative position. The center of mass is sometimes called the center of inertia or center of gravity.

Another important benefit of the presently described embodiment of the invention is that the crown molding system can be easily reused. Because there is only a single attachment point, and because no finishing materials such as spackle or caulk are used, the removal of the fastener 37 from the wall 32 and mounting flange 6 in FIGS. 9 and 10 releases the molding system from the wall. This is of value where frequent redesigns or remodels of an interior space are to be expected, for example in an office building where a new tenant may wish to redesign an office suite to fit specific needs. Reuse is also an important criterion for achieving certain Green Building incentives, such as LEED certification, according to the U.S. Green Building Council. It is also contemplated that the crown molding assembly described herein although sufficiently rigid to maintain its structural integrity while supporting in some embodiments a portion of a nonstructural ceiling, that at least a modicum of vertical flexibility be incorporated into the structure, so that when the main structure is applied to a wall surface that is uneven due to settling of the building or the like, the structure is flexible enough to bend slightly and therefore to follow the uneven contour of the wall. Thus, such an arrangement would ensure that no gaps were present between the vertical wall surface and the rear surface of the molding assembly. In particular, using known construction methods the flexibility of the rear surface of the molding assembly could be augmented without reducing the structural integrity of the main structure and particularly without altering the angle of the decorative surface and manner of attachment to a wall surface.

While the present invention has been described at some length and with some particularly with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

What is claimed is:

1. A crown molding for installation at or near the top of a vertical wall, to be attached either directly to the wall surface or to a substantially vertical surface connected to the vertical wall, said molding having a unitary construction and a cross section comprising:

a) a vertical mounting surface for engaging the wall or vertical surface;

b) an attachment surface adapted for securing the unitary molding to the wall or vertical surface at an attachment point with the vertical mounting surface engaged with the wall or vertical surface, said attachment surface being the only surface on the molding cross section by which the molding is secured to the wall or vertical surface, and said attachment point defining a pivot point;

c) a decorative face facing outwardly in a single direction and oriented opposite from the vertical mounting surface and attachment surface, the entirety of which decorative face is facing outwardly away from the wall or vertical surface when the vertical mounting surface is engaged with the wall or vertical surface and attachment surface, said molding having a structural rigidity such that the angle and position of the decorative face relative to the vertical mounting surface is maintained;

d) said attachment surface only being accessible from above the decorative face of said unitary molding when the molding is engaged with the wall or vertical surface, and when secured to the wall or vertical surface at the attachment point the unitary molding having a center of mass located at a lower position on the molding cross section than the attachment point, resulting in the portion of the molding below the pivot point being continually urged in the direction of the wall or vertical surface.

2. The molding of claim 1 in which the decorative face additionally comprises an upper edge and a lower edge which terminates along its entire length at the vertical mounting surface.

3. The molding section of claim 1 in which the attachment surface is a flange.

4. A crown molding section comprising:

a) an elongated unitary body having an upper end, a lower end, an outer decorative face facing outwardly in a single direction and extending between said upper end and lower end, and a rear surface for engagement with a wall surface or to a substantially vertical surface connected to a wall surface, said rear surface facing oppositely away from the outer decorative face;

b) means for securing the crown molding section to said vertical wall surface or vertical surface with the rear surface abutting against said vertical wall surface or vertical wall at only one attachment location in the molding cross section between the upper and lower ends of the body, said attachment location being accessible only from said upper end of the unitary body;

c) said crown molding section when secured to the vertical wall surface or vertical surface at said single attachment location having a center of mass located in closer proximity to the lower end of the crown molding section than the attachment location is to said lower end, causing the lower end to be continually biased toward the vertical wall surface or vertical surface.

5. A crown molding section requiring minimum tacking to an adjacent wall surface comprising:

a) a relatively flattened attachment portion;

b) an outwardly expanded decorative molded portion;

c) the relatively flattened attachment portion encompassing an attachment point positioned either above or behind the decorative molded portion by which the crown molding section can be stably suspended from the wall surface as a discrete section of crown molding, and when suspended from said wall surface the outwardly expanded decorative molded portion is aligned longitudinally with the wall surface and the center of mass of the crown molding section being below any attachment point and the decorative molded portion faces outwardly in a single direction;

d) the attachment point of the relatively flattened attachment portion adapted to be secured to the wall surface by a single piercing type fastening and being accessible only from above the decorative molded portion;

e) a surface for supporting one or more nonstructural ceiling panels forming part of a nonstructural ceiling system;

f) whereby the crown molding section is stably mountable to the wall surface beneath the juncture of said wall surface and a more elevated ceiling.

6. The improved crown molding section of claim 5 in which the flattened attachment portion extends above said decorative molded portion, and the outwardly expanded decorative molded portion has an upper edge which extends outwardly from the adjacent wall surface between two and six times greater than the distance the relatively flattened attachment portion extends above said upper edge, thereby blocking from the view of an observer standing on a floor in a room in which the crown molding is used the piercing type fastening in the relatively flattened attachment portion of the crown molding section.

* * * * *